US005487244A

United States Patent [19]

Hill

[11] Patent Number: 5,487,244

[45] Date of Patent: Jan. 30, 1996

[54] SHUTTER SYSTEM AND METHOD

[76] Inventor: George A. Hill, 8561 NW. 52nd St., Lauderhill, Fla. 33351

[21] Appl. No.: 344,222

[22] Filed: Nov. 23, 1994

[51] Int. Cl.[6] ..... E06B 3/26

[52] U.S. Cl. ..... 52/202; 52/783.12; 52/748.1; 49/57; 49/61

[58] Field of Search ..... 52/202, 783.11, 52/783.12, 783.14, 783.15, 784.1, 579, 746.1, 748.1; 49/57, 61, 62, 464

[56] References Cited

U.S. PATENT DOCUMENTS

| | | | |
|---|---|---|---|
| 4,333,271 | 6/1982 | DePaolo et al. | 49/464 |
| 5,345,716 | 9/1994 | Caplan | 49/61 |
| 5,426,893 | 6/1995 | Hoffman | 52/202 X |

*Primary Examiner*—Creighton Smith
*Attorney, Agent, or Firm*—Jack E. Dominik

[57] ABSTRACT

A shutter system and method in which the shutters are normally rolled to a nominal one foot width and have an infinite length, normally no less than two feet and no more than twelve feet is disclosed. These dimensions can be modified on one foot modules. The shutters are provided with a self-secured panel lock assembly at the overlapping joints on the inside between the shutter and windows normally on two foot spacing vertically. This can be horizontal, however, in other applications. The system includes the utilization of an angle frame at the base, and an overlapping receiver as a header. End caps may be of varying shapes but normally are typical L-shaped angles. The shutters are installed by raising the same upwardly and inwardly to the overhang on the upper header, lowering the same to the point where the lower portion overlap has a keyhole slot, aligning the same, and then manually threading the panel lock assembly in place and the bottom lock screw in place. Where the extrusions of the system are not employed, the threaded members engage a concrete anchor secured in the wall of the structure.

7 Claims, 3 Drawing Sheets

SHUTTER SYSTEM AND METHOD

BACKGROUND OF THE INVENTION

The present invention relates to shutters of the hurricane variety which are removably secured normally to a dwelling when a hurricane or other strong wind is anticipated. It also has utility in "boarding up" of a house which may be empty for a significant period of time.

SUMMARY OF THE PRIOR ART

A wide variety of shutters such as hurricane shutters have been used starting from the most simplistic five-eighths inch plywood which is screwed or nailed to the wall of a building to overlie a window, to roll up and roll down shutters. The former are inexpensive but not durable and reliable, and the latter are expensive and in some instances relatively unsightly.

After Hurricane Andrew in Dade County, Fla. and elsewhere in the country, the requirements for shock testing, impact loading, static loading, and installation have become significantly more strict.

The installation of shutters normally utilizing a strap across the rear portion with nuts going through the front of the corrugated panels, can be cumbersome and difficult to achieve the appropriate spaced relationship.

Illustrative of the prior art are U.S. Pat. Nos. 2,568,195 to Jones which discloses overlapping storm shutters, female anchors in concrete, and brackets permanently affixed to the building; 2,719,750 to Orr discloses a keyhole slot in a panel for attachment to an automobile; 2,867,011 to Becjer discloses a shutter structure using a fastener comprising a thumb screw and wing nut for attaching storm shutters together; and 2,878,536 discloses corrugated overlapping shutters having brackets affixed to the building. None of the subject patents discloses an entire shutter system to generate a strong monocoque shield which can be quickly installed and dismounted by a single person using no tools.

What is needed is a system including panels and the joint structure which can be readily installed by the home owner without the use of any special tools. Despite that simplistic approach, it must have significant strength characteristics.

SUMMARY OF THE INVENTION

The present invention is directed to a shutter system and method in which the shutters are normally rolled to a nominal one foot width and have an infinite length, normally no less than two feet and no more than twelve feet. These dimensions can be modified on one foot modules. The shutters are provided with a self-secured panel lock assembly at the overlapping joints on the inside between the shutter and windows normally on two foot spacing vertically. This can be horizontal, however, in other applications. The system includes the utilization of an angle frame at the base, and an overlapping receiver as a header. End caps may be of varying shapes but normally are typical L-shaped angles. The shutters are installed by raising the same upwardly and inwardly to the overhang on the upper header, lowering the same to the point where the lower portion overlap has a keyhole slot, aligning the same, and then manually threading the panel lock assembly in place and the bottom lock screw in place. Where the extrusions of the system are not employed, the threaded members engage a concrete anchor secured in the wall of the structure.

Accordingly, it is a principal object of the present invention to provide a shutter, secured in a given system, and method for erecting the same which will pass the most stringent impact and static loads, and yet be inexpensive and easy to install by the home owner without any special tools.

Yet another object of the present invention is to provide a shutter, system, and method which will accommodate a wide variety of window openings, whether fixed, sliding, vertically movable, or otherwise installed.

Still another object of the present invention looks to a structure which has the flexibility from a standpoint of the installation to accommodate a wide variety of contractor and builder requirements.

BRIEF DESCRIPTION OF THE ILLUSTRATIVE DRAWINGS

The subject invention will be better understood taken in conjunction with the accompanying illustrative drawings, in which.

DESCRIPTION OF A PREFERRED EMBODIMENT

Figure 1:
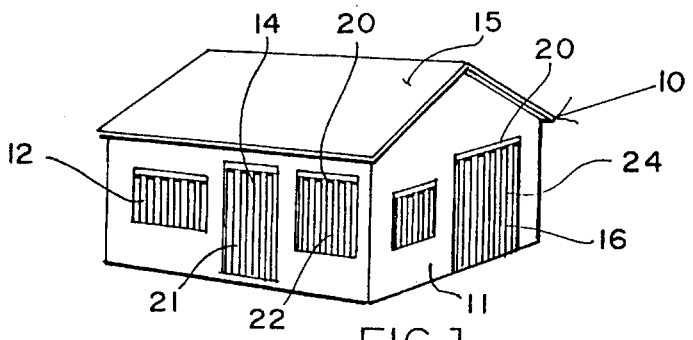
FIG. 1 is a perspective of a house showing a typical illustration of the subject shutter system and method employing the header, footer, and end caps of the system.

A typical installation of the subject shutter systems in several applications is shown in FIG. 1. There it will be seen that the house 10 has a plurality of walls 11, and windows 12. A door 14 is centrally disposed in the front wall of the building 10, and a sliding door 16 at a sidewall portion of the building 10.

Figure 7:
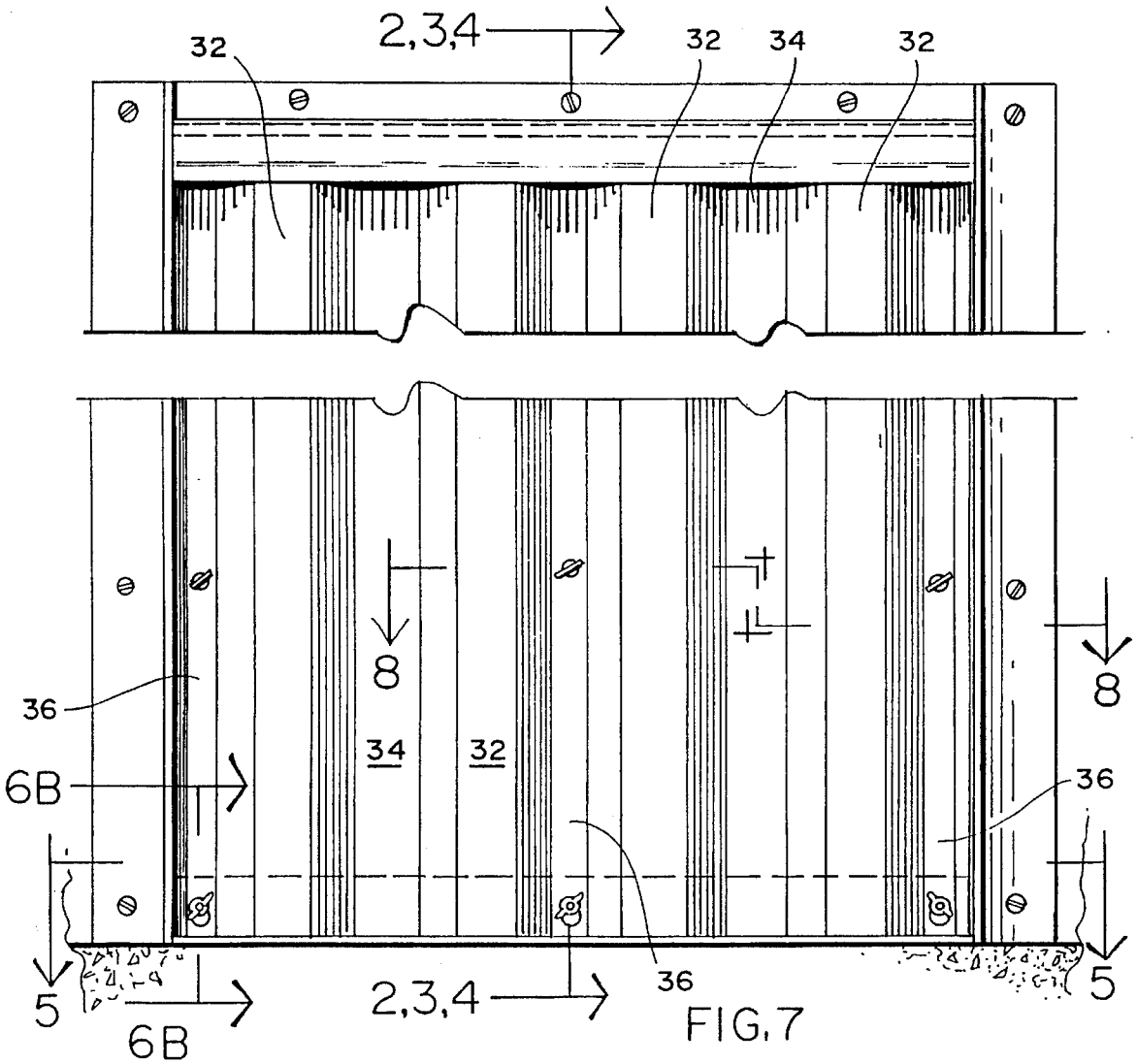
FIG. 7 is a plan view of a typical panel system.

The shutter system 20 as installed, in broad outline, will be best illustrated by reference to FIG. 7. There it will be seen that a plurality of shutter panels 30 have been joined together in a typical slide door 16 type installation. The sliding door shutter system 24 is noted in FIG. 1 where it will also be noted that there is a door shutter system 21 and a window shutter system 22.

Figure 8:
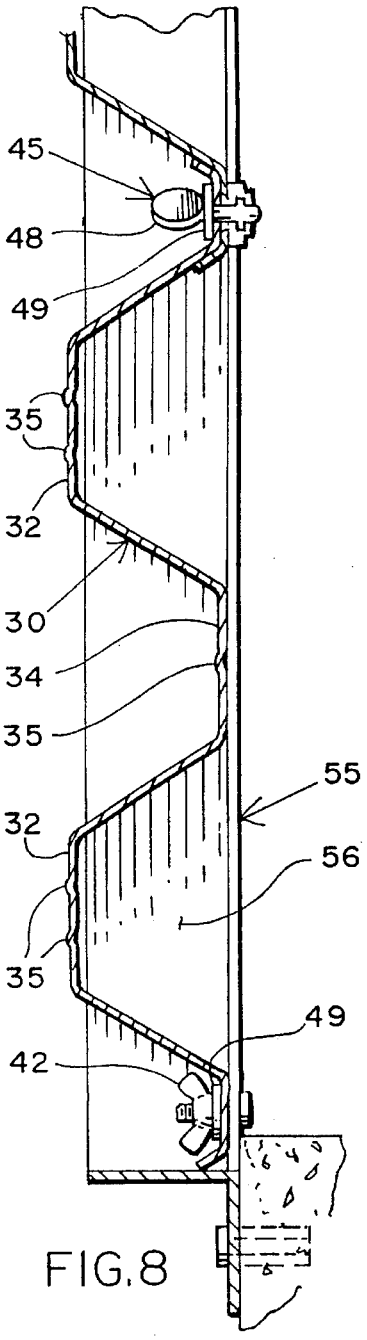
FIG. 8 is a transverse sectional view of a typical panel.

Turning now to FIG. 8 it will be seen that the illustrative shutter panel 30 includes a plurality of isosceles trapezoidal corrugations 31, including a ridge 32, and a groove portion 34. Ribs 35 are provided, as shown here, two on the ridge 32 and one centrally disposed on the bottom of the groove 34.

Figure 9:
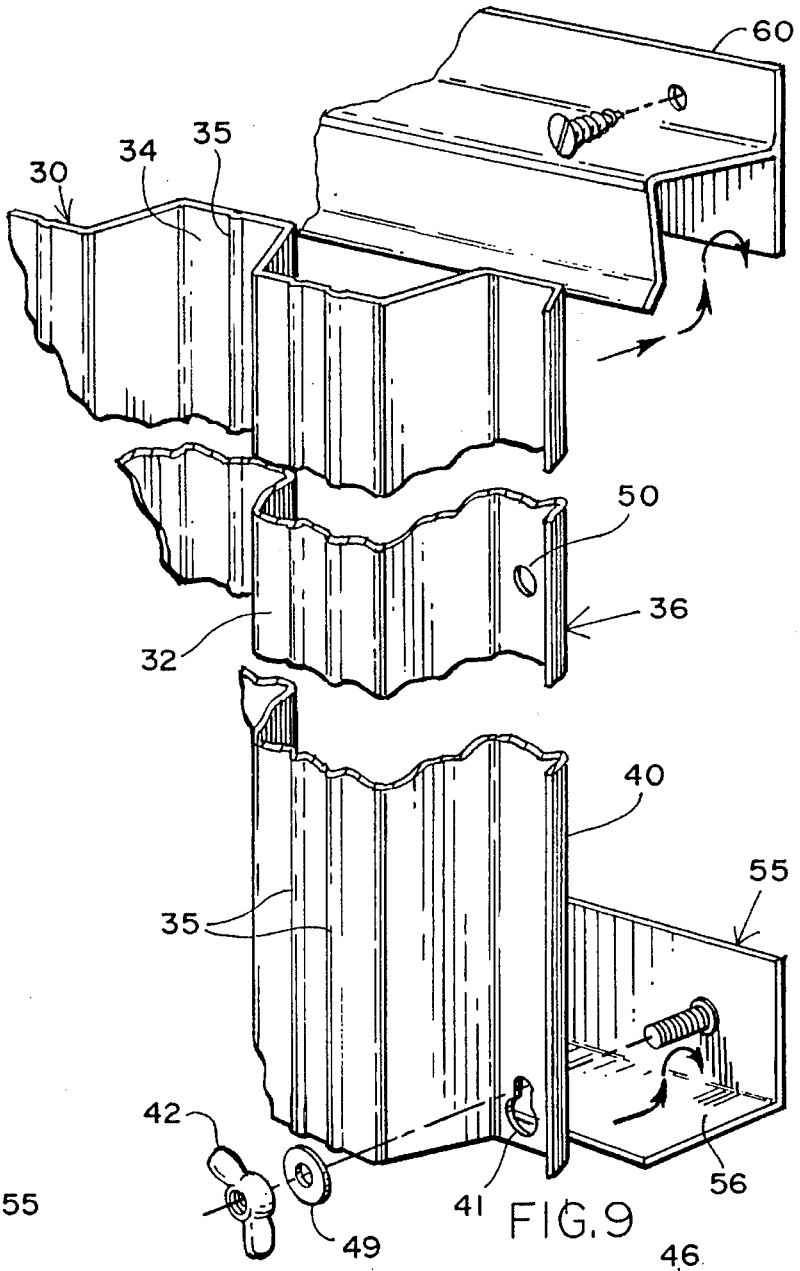
FIG. 9 is an exploded perspective partially broken view of the shutter system illustrative of the present invention.
Figure 10:
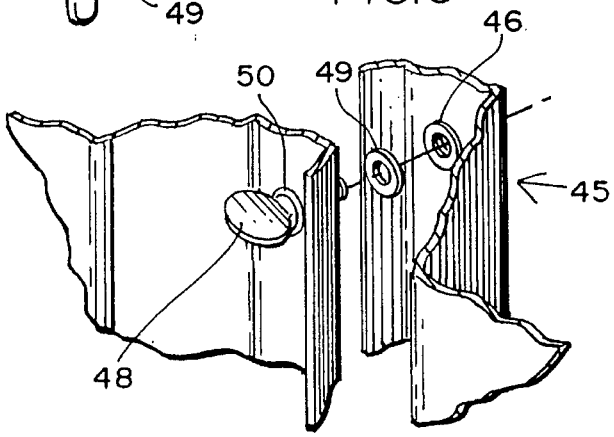
FIG. 10 is an enlarged perspective broken view concentrating on the lap joint and jack screw attachment portion of the system.

Turning now to FIGS. 9 and 10, there it will be seen that the lateral lip 36 has a lip bottom 38 and a lip edge lock 40. A keyhole opening 41 is provided in the lip bottom 38 at the lower extremity of the panel 30. The upper portion of the panel 30 mounts in a header 60 which may take various configurations as will be shown in the description of FIGS. 2, 3 and 4.

Turning now to FIG. 10 it will be seen that the panel lock assembly 45 includes a jack nut 46 which is secured to the lip channel 38 of the lip 36. A thumb screw 48 penetrates the lip bottom 38, passes through jack nut washer 49, and is threadedly engaged in the jack nut 46 by merely rotating with the thumb and forefinger.

Figure 2:
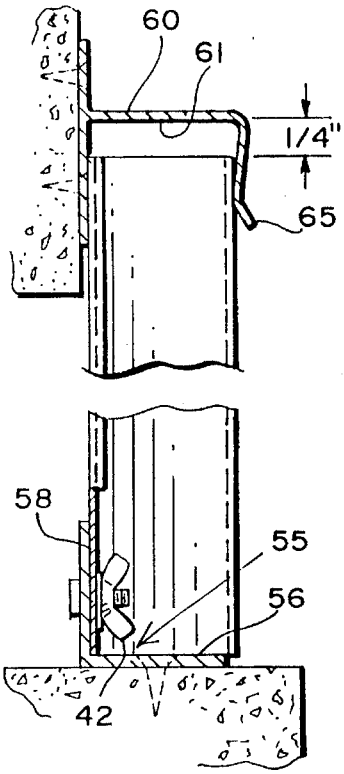
FIG. 2 is a transverse sectional view of a typical installation directly wall mounted taken along section 2—2 of FIG. 7.
Figure 3:
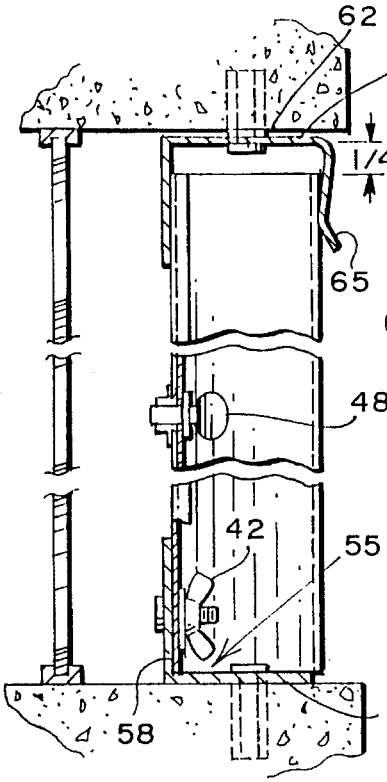
FIG. 3 is a transverse sectional view of a typical system ceiling mounted taken along section 3—3 of FIG. 7.
Figure 4:
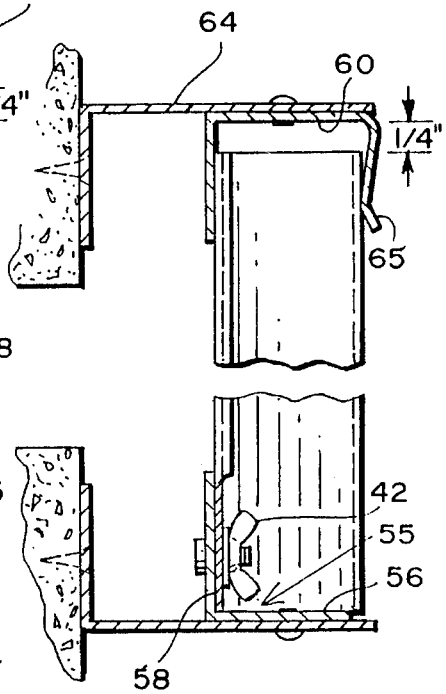
FIG. 4 is a transverse sectional view showing the same in a typical build-out or extended condition taken along 4—4 of FIG. 7.
Figure 5:
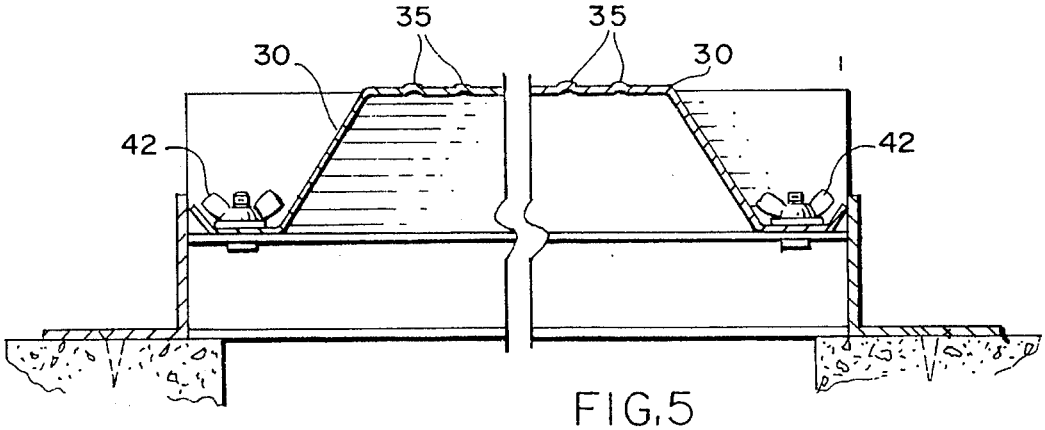
FIG. 5 is an end cap build-out condition taken at 5—5 of FIG. 7.

Various foot constructions 56 and header construction 60 are shown in FIGS. 2, 3, and 4. In the construction of FIG. 2, the foot 55 has a bottom 56 which is secured to a concrete or masonry or other type of sill at the lower portion of the bottom 56 of the foot 55. The shutter face 58 is engaged by the wing nut 42. In the system of FIG. 2 the header 60 includes a wall mount portion 61 and the header mount 62. In the embodiment shown in FIG. 3 which is spaced away from the window but interiorly of the sill, the header 60 is mounted by a typical masonry engaging support. In each instance, the header 60 has a grip portion 65 to engage the panel 30 upper portion. Finally, the extended mount 64 is shown in FIG. 4 where the entire shutter assembly system 20 is extended from the wall of the building structure.

Figure 6A:
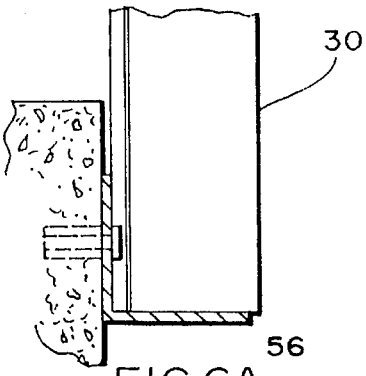
FIG. 6A is a further removable sill application and sill in broken form.
Figure 6B:
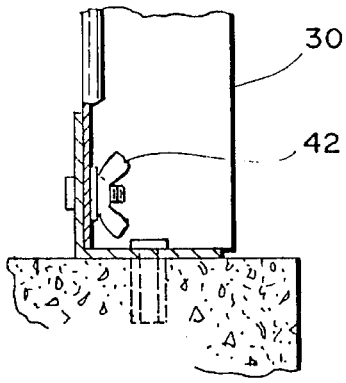
FIG. 6B shows a floor mount.

FIGS. 6A and 6B show illustrative floor mounts, FIG. 6A flush to the front portion of the floor, and FIG. 6B flush with the upper portion of the floor system. An illustrative embodiment of the present invention the panel 30 of FIG. 8 is nominally twelve inches from suspension point to suspension point. There is an overhang on either side to provide a lip engaging portion for the adjacent panel 30. Normally the height of the two corrugations 31 is two inches, the groove 34 is two inches, and the spacing of the top portion are 4.5 inches. A 0.063 thick aluminum 5052-H32 alloy is employed.

To further impart strength to the system 20, a pair of spaced longitudinal ribs 35 are provided on the upper portion of the corrugation 31, with a single longitudinal rib 35 on the lower groove portion 34. The header 60 is provided with spacing of 2.15 inches at the narrowest portion to snugly receive each of the panels 30 as it is slipped upwardly into the header 60, and then lowered onto the footer.

Each of the panels is provided with one or more jack nuts 46 which has its female portion securely mounted to the lip 36 of the underlying lip bottom 30 on the panel 30, and in spaced relationship longitudinally along the joint. A thumb screw 48 is provided to secure from the overlapping adjacent panel through the underlying fixed jack nut 46.

At the other end of the joint, a keyhole slot 41 is provided in both sides so that a bolt secured from the rear portion of the L-shaped receiver can be mounted as a hanger. To this end, a keyhole slot is provided in which the dimensions of the slot are at least 25% to 50% larger than the diameter of the bolt. The round portion of the keyhole slot is significantly larger. With the hole that the wing nut passes through to the fixed nut on the underlying lower shoe of the panel, a 25% to 50% oversized hole is also desirably added.

When the header 60 and sill are not employed 28, the shutters are ideally secured by anchors in concrete which are one-quarter inch tapcons, one and three-quarter inch imbedded or equivalent. For removable applications, it is best to use Rawl Caulk-In anchors which are one-quarter inch by seven-eighths inch imbedded or equivalent.

All bolts, nuts, and washers are ideally stainless steel or aluminum alloy 2024-T4 or 7075-T6 or plated steel. The ideal ceiling header 60 has a foot portion 0.062 inches thick, with the bridge and overlap 0.100 inches. The same is proportioned so that the foot extends at least one-half inch beyond the shadow of the overlapping securing top member to permit easy access for drilling to secure the same to a wall.

More specifically, the panels 30 are ideally 0.063 aluminum alloy 5052-832 or ASTMB209-92A. They have a nominal width of twelve inches, with a total width of 13.5 inches, forming 2.00 inch deep ribs. The minimum separation to existing glass which is to be protected is 2.55 inches. The maximum clearance between the top of the panel and the inside of the header is one-quarter inches. As to special requirements, a one-quarter inch by one-half inch thumb screw 48 with washer 49 goes into the jack nut 46. They are spaced at twenty-four inch centers longitudinally along the joint, and are used to join all panels at the lap joints.

Installation proceeds as follows:

A) Wall Mount (Direct Mount)

The panels are secured inside a top track (wall mount header) 60 at the head, which is anchored to the wall, and fastened to the 2"×2"×0.125" (floor angle) continuous studded aluminum angle at the sill, using ¼"-20 studs with washer wing nut spaced at 12" o.c.

B) Ceiling/Inside Mount

The panels are secured inside a top track (ceiling mount header) at the head, which is anchored to the inside of opening, and fastened to the 2"×2"×0.125" (floor angle) continuous studded aluminum angle at the sill, using ¼"-20 studs with washer wing nut spaced at 12" o.c.

C) Built-Out Condition

Same as above, except (as shown in FIG. 4) that the (ceiling mount header 60) at the top and the 2"×2"×0.125" continuous studded aluminum angle (floor angle) at the sill, are each secured with #10–16×¾" #2 point self-drilling hex washer head screws spaced at 12" o.c. to a 2"×4"×⅛" aluminum angle (built-out support) used to provide the build out and which is anchored to the wall.

D) Any Combination of the Above

Anchorage of the aluminum angles shall be to concrete, masonry and/or wood framing and shall consist of only the anchors. Permanent set fastener components, embedded anchor bolts, threaded cones or metal shields, not in use, must be protected against corrosion, contamination and damage at all time.

The method of the present invention is directed to the installation of overlapping shutters in which the same are secured to the building structure by keyhole slots at the lower portion, and a keyhole slot at the upper portion in the event a header is not employed. The installer positions the units over the keyhole slots and into the upper portion first, and then thereafter takes the thumb screws and manually secures them into the jack nuts which are securely fixed to the underneath portion of the overlapped portion of the adjacent panel.

It will be understood that various changes in the details, materials and arrangements of parts which have been herein described and illustrated in order to explain the nature of the invention, may be made by those skilled in the art within the principle and scope of the invention as expressed in the appended claims.

What is claimed is:

1. A shutter panel for use in a shutter system having a header and a footer for receiving a plurality of such shutters, said shutter comprising, in combination:

a corrugated body having a central groove and parallel flanking ridges, said groove and ridges comprising an isosceles trapezoidal cross-section;

a plurality of ribs longitudinal along said ridges and grooves, extending outwardly therefrom;

said panel having lateral edges terminating in a pair of parallel lips;

each such lip having a lip bottom and an edge lock angled upwardly from the lip bottom, such that each panel can be overlapped with a like panel along their lips;

vertically spaced releasably securable means along the lip bottoms for securing said panel to a like panel that has been placed adjacent thereto and overlapped along the lip; and a laterally spaced releasably securable means for securing said panel to the footer, whereby like panels, when placed adjacent said panel and overlapped along the lips, can be secured both to the footer and to each other to form an interlocked panel system that inhibits wind from getting between the adjacent, overlapped panels.

2. In the shutter panel of claim 1 above, said vertically spaced releasably securable means comprising:

vertically spaced jacknuts permanently affixed to one side of the panel along one of the lip bottoms, said jacknuts being capable of receiving threaded screws; and vertically spaced lock holes along the lip bottom opposite the lip bottom containing said jacknuts, said lock holes being spaced to laterally oppose said jacknuts, whereby like panels, when placed adjacent said panel and overlapped along the lips, can be secured both to each other through the use of threaded screws to form an interlocked panel system that inhibits wind from getting between the adjacent, overlapped panels.

3. In the shutter panel of claim 1 above, said laterally spaced releasably securable means comprising:

laterally spaced keyhole openings for receiving threaded bolts, said openings being spaced along that portion of the panel which is placed adjacent the footer; and said keyhole openings being proportioned to have a diameter of at least 25% more than the bolts to be passed therethrough, whereby threaded bolts can be passed through said openings by a single person without precise alignment, and the panel be thereby secured to the footer, and to any adjacent overlapped panel.

4. A shutter system for enclosing an opening in a wall of a structure comprising, in combination:

a header member essentially of a U-shaped track being positioned with the open side of the U-shaped track facing downward;

a footer having a vertical face with threaded means for receiving nuts; and a plurality of shutter panels, each of said panels having lateral edges that terminate in a pair of parallel lips, each such lip having a lip bottom and an edge lock angled upwardly from the lip bottom, such that each panel can be overlapped with a like panel along their lips, each of said panels having a vertically spaced releasably securable means along the lip bottoms for securing said panel to a like panel that has been placed adjacent thereto and overlapped along the lip, each of said panels having a laterally spaced releasably securable means for securing said panel to the footer, each U-shaped track member being proportioned approximately the same size of the panels so as to be capable of receiving the same, each panel being characterized by an isosceles trapezoidal cross-sectioned configuration comprised of a pair of parallel ribs flanking a single groove, whereby the panels can be raised into the header and overlapped on their lips and secured both to the footer and to each other to form an interlocked panel system that inhibits wind from getting between the adjacent, overlapped panels.

5. In the shutter system of claim 4 above, said header having a depending portion that extends upward from the U-shaped track to allow the header to be secured to the wall of the structure being protected by the shutter system.

6. In the shutter system of claim 4 above, said footer having a horizontal face that extends outwardly from the vertical face to support the panels being installed.

7. The method of assembling a shutter system for enclosing an opening in a wall of a structure in which a plurality of shutters is employed, each of which has an isosceles cross-section configuration including a pair of parallel ribs flanking a single groove and lateral edges with lips, and each of the shutters having a keyhole mounting means, the steps comprising:

securing a header member to the wall above the opening, said header member being essentially a U-shaped track with the "U" pointing downward;

securing a footer member to the wall below the opening, said footer having a vertical face with mounting means for receiving threaded nuts;

securing each of the panels firstly upwardly into the header, and thereafter placing each of the shutter's keyhole mounting means over the mounting means on the footer overlapping adjacent panels by their lips only;

positioning uniformly spaced panel lock assemblies along the lips of adjacent overlapped shutter panels; and engaging the panel lock assemblies and the keyhole mounting means to secure the panels to the footer and to each other, thereby enclosing the opening in the wall of the structure.

* * * * *